United States Patent [19]

Bull

[11] 4,081,633

[45] Mar. 28, 1978

[54] MULTI-FUNCTION ELECTRICAL SWITCH ASSEMBLY

[75] Inventor: David W. Bull, Hersey, Mich.

[73] Assignee: Nartron Corporation, Reed City, Mich.

[21] Appl. No.: 666,746

[22] Filed: Mar. 15, 1976

[51] Int. Cl.[2] ..... H01H 13/36

[52] U.S. Cl. ..... 200/67 DA; 200/68; 200/77; 200/324; 200/339

[58] Field of Search ..... 200/67 R, 67 D, 67 DA, 200/68, 76, 77, 78, 339, 322, 324

[56] References Cited

U.S. PATENT DOCUMENTS

| | | | |
|---|---|---|---|
| 1,398,053 | 11/1921 | Wollenweber | 200/78 |
| 2,750,463 | 6/1956 | Roeser | 200/67 D |
| 2,848,575 | 8/1958 | Hahn, Jr. | 200/77 |
| 2,885,905 | 5/1959 | Larkin | 200/322 |
| 3,329,784 | 7/1967 | Rogero | 200/68 |
| 3,335,240 | 8/1967 | Dhaens | 200/67 DA |
| 3,819,891 | 6/1974 | Miller et al. | 200/67 D |
| 4,012,608 | 3/1977 | Lockard | 200/76 |

*Primary Examiner*—Samuel W. Engle
*Assistant Examiner*—Ralph Palo
*Attorney, Agent, or Firm*—Lon H. Romanski

[57] ABSTRACT

A multi-function electrical switch assembly has body sections defining therebetween a chamber containing spaced fixed electrical contacts and spaced moveable electrical contacts carried by a plunger member which is resiliently restrained from moving the moveable contacts toward the fixed electrical contacts; a second set of electrical terminals are defined by a fixed terminal connected to a moveable deflectable arm carrying a first contact which, upon such arm being sufficiently deflected by the plunger, engages a cooperating second fixed contact.

9 Claims, 16 Drawing Figures

MULTI-FUNCTION ELECTRICAL SWITCH ASSEMBLY

BACKGROUND OF THE INVENTION

The prior art has proposed various forms of normally open electrical switch assemblies; however, such have not been found to satisfy a great number of application requirements. For example, especially where relatively high electrical currents are to be experienced in the switch itself, any slow movement of one moveable electrical contact toward another will quickly result in deterioration of such electrical contacts because of electrical arcing which will take place between such contacts as they experience slow relative motion therebetween.

Attempts to, in turn, cause rapid motion of such moveable contacts as by the employment of manually actuated cam means have not proven to be satisfactory because, aside from the increased cost of such cams, the motion of the cam is still, in the main, directly dependent upon the rate of speed at which manual actuation is performed.

Other attempts at creating switch assemblies wherein a snap action is introduced into the movement of such moveable contacts have, to a functional degree, succeeded; however, such arrangements have usually required sensitive over-center type tripping mechanisms or other relatively complex and costly mechanisms. Further, in such prior art snap-acting switch assemblies it is usually impossible to attain such a snap-action movement when the total permissible travel of the related actuating member is very short.

Further, the prior art has failed to provide, in the same switch assembly, means for both affecting a snap-action switching function as well as additional switching functions not requiring a snap-action.

Accordingly, the invention as herein disclosed and described is primarily directed to the solution of the above as well as other related problems.

SUMMARY OF THE INVENTION

According to the invention, an electric switch assembly comprises at least first and second relatively fixed electrical conductor means spaced from each other, third electrical conductor means normally operatively secured to said first but spaced from said second electrical conductor means, resiliant restraining means operatively connected to said third electrical conductor means spaced from said first and second electrical conductor means, fourth and fifth fixed spaced electrical contact means adapted for cooperative engagement with respective sixth and seventh moveable electrical contact means, and actuator means effective for moving said sixth and seventh contact means toward said fourth and fifth contact means and for creating a force against said resilient restraining means so as to cause said third electrical conductor means to move toward said second electrical conductor means and thereby complete an electrical circuit across said first and second electrical conductor means and said fourth and fifth contact means.

Various general and specific objects and advantages of the invention will become apparent when reference is made to the following detailed description considered in conjunction with the accompanying drawings.

BRIEF DESCRIPTION OF THE DRAWINGS

In the drawings, wherein for purposes of clarity certain details and elements may be omitted from one or more views.

DESCRIPTION OF THE PREFERRED EMBODIMENTS

Figure 1:
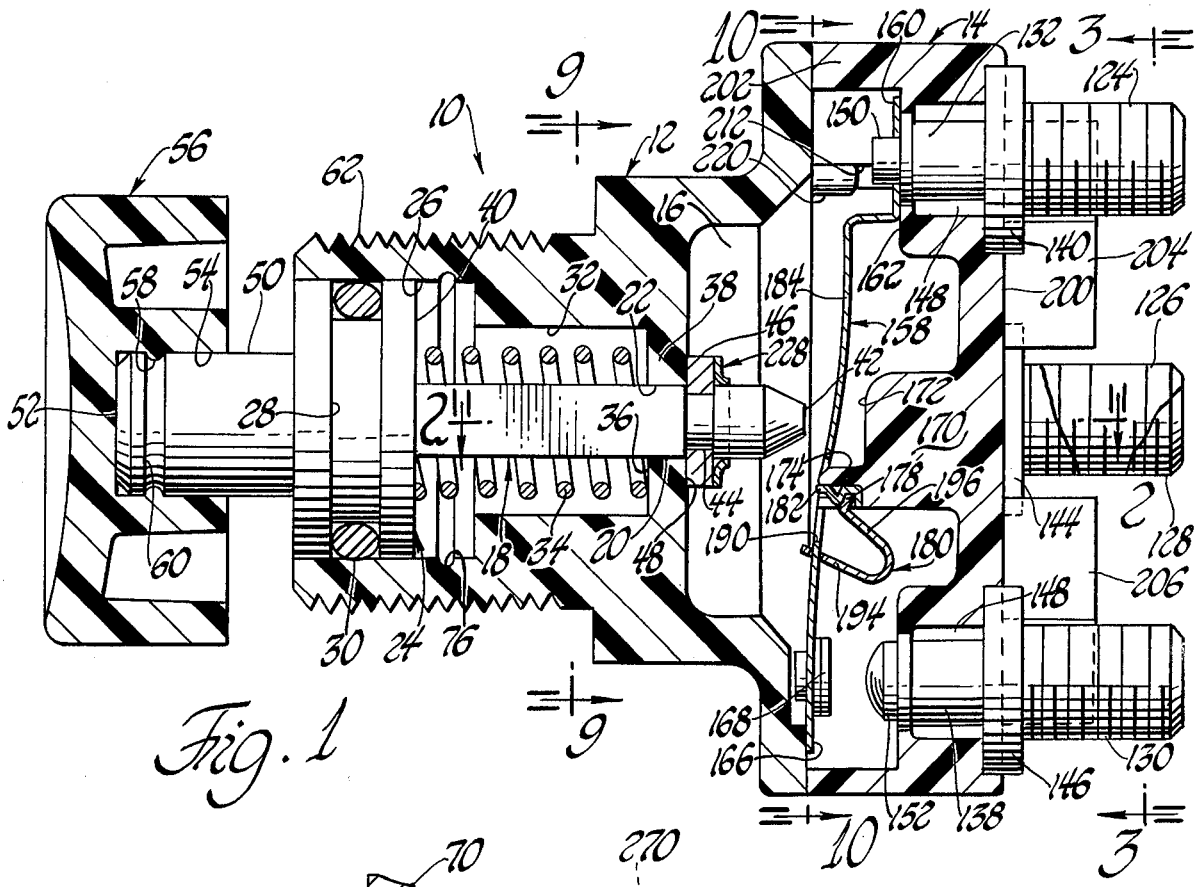
FIG. 1 is an axial cross-sectional view of a switch assembly embodying the teachings of the invention.
Figure 2:
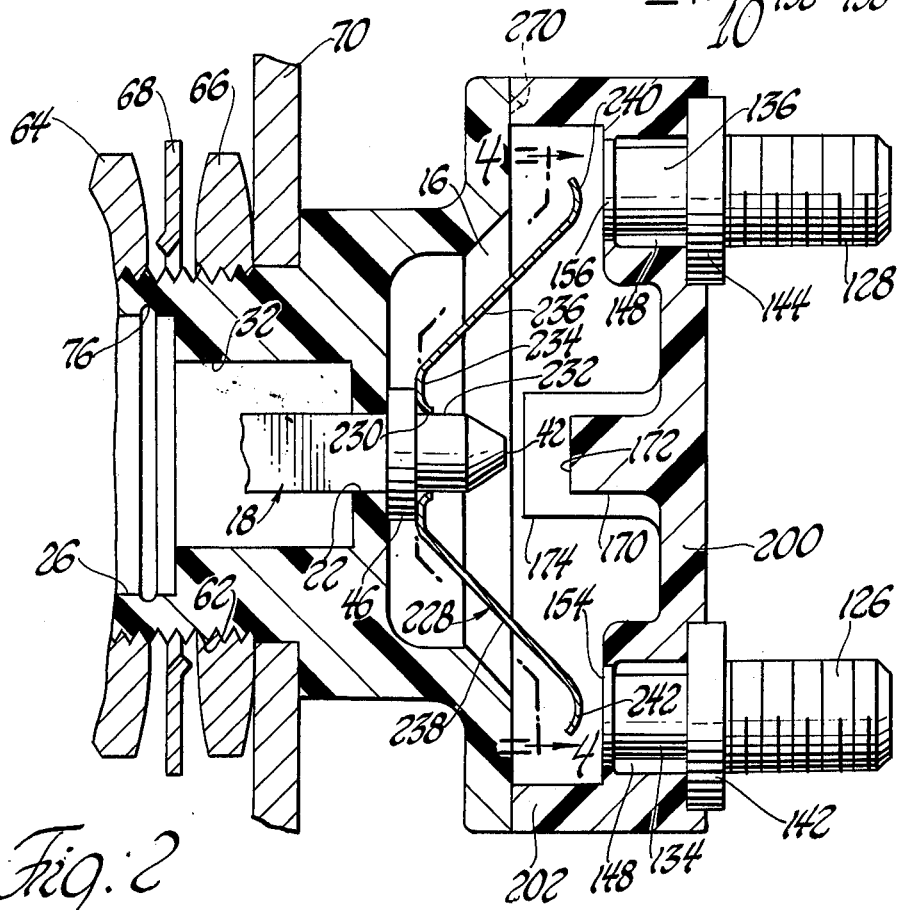
FIG. 2 is a fragmentary axial cross-sectional view taken generally on the line 2—2 of FIG. 1 and looking in the direction of the arrows.

Referring now in greater detail to the drawings, FIGS. 1 and 2 illustrate a switch assembly 10, constructed in accordance with the teachings of the invention, as comprising first and second housing sections 12 and 14, preferably of electrically nonconductive material, which, when assembled, generally define a chamber 16 therebetween.

Figure 9:
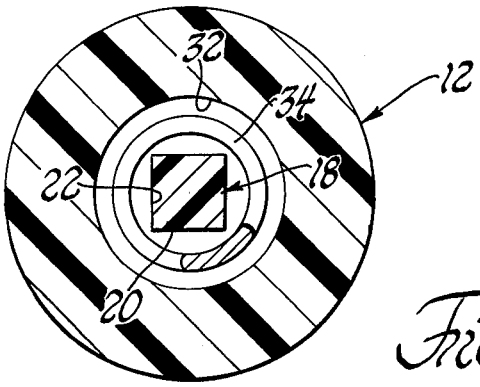
FIG. 9 is an axially transverse cross-sectional view taken generally of the plane of line 9—9 of FIG. 1 and looking in the direction of the arrows.

A plunger-like actuating member 18, preferably formed of electrically non-conductive material, has a first stem portion 20 slidably received as within a guide passageway 22 formed in housing section 12 and a second relatively enlarged cylindrical portion 24 slidably received within a cooperating cylindrical chamber or recess 26 also formed in housing or body section 12. Preferably, stem portion 20 has its longitudinal sides flatted, as for example, to be of square cross-section as shown in FIG. 9, in order to have such flat sides cooperate with juxtaposed squared sides of aperture 22. The enlarged portion 24 is preferably provided with an annular peripheral groove or recess 28 which, in turn, receives an annular seal 30 which, in fact, may be of the O-ring type. Seal 30 functions to seal the inner spaces of the switch assembly 10 from the ambient atmosphere.

A relatively enlarged chamber 32 accepts a compression spring 34 which has one end operatively seated against surface 36 of transverse wall portion 38 and has its other end operatively seated against axial end surface 40 of cylindrical enlargement 24. Near the inner-most end 42 of stem 18 is formed an annular groove or recess 44 which receives a C-like retainer or abutment member 46 effective to serve as an abutment or stop in cooperation with surface 48 of wall portion 38. As spring 34 normally urges plunger member 18 to the left, as viewed in FIG. 1, abutment or stop means 46 limits the left-ward movement of plunger 18.

An extension 50, carried by plunger means 18, has a free end 52 which is operatively received within a recess 54 formed within a cap or button-like member 56. Preferably, cap member 56 is formed of material having a noticeable degree of resilient deflection whereby an internally formed annular detent ring portion 58, and the body portion of cap 56 thereabout, can undergo resilient deflection during assembly of the cap 56 to extension 50 and eventually enabling such ring 58 to be received with the annular recess 60 formed generally peripherally in extension 50.

The shank portion of body section 12 is preferably threaded as at 62 as for threadable engagement with cooperating nuts 64 and 66 between which a lock-type washer 68 may be situated. Nuts 64 and 66 may be employed for retaining the entire switch assembly 10 to a suitable related support structure as, for example, fragmentarily illustrated at 70.

Generally, as can be seen, when the actuating means 56 is engaged and pressed generally inwardly toward the remaining portion of the switch assembly 10, plunger means 18, against the resilient resistance of spring 34, is moved further inwardly (towards the right as viewed in FIGS. 1 and 2) moving end 42 correspondingly. When the actuating means 56 is released, spring 34 serves to return plunger means 18 and actuating means 56 to the position shown in FIGS. 1 and 2 with abutment 46 functioning as a stop means to determine the left-ward most position of plunger means 18.

Figure 4:
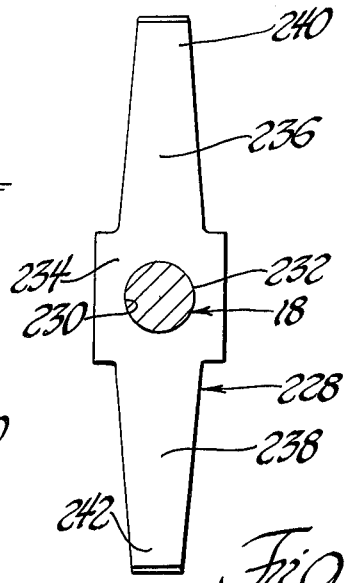
FIG. 4 is a view taken generally on the plane of line 4—4 of FIG. 2, and looking in the direction of the arrows, illustrating one of the elements therein.
Figure 5:
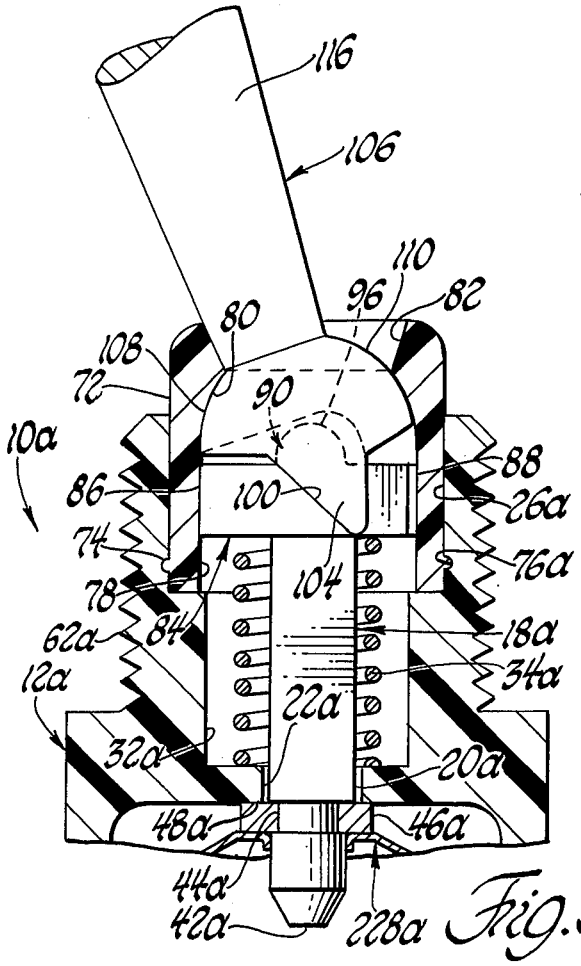
FIG. 5 is a fragmentary axial cross-sectional view illustrating a modified form of the invention.
Figure 6:
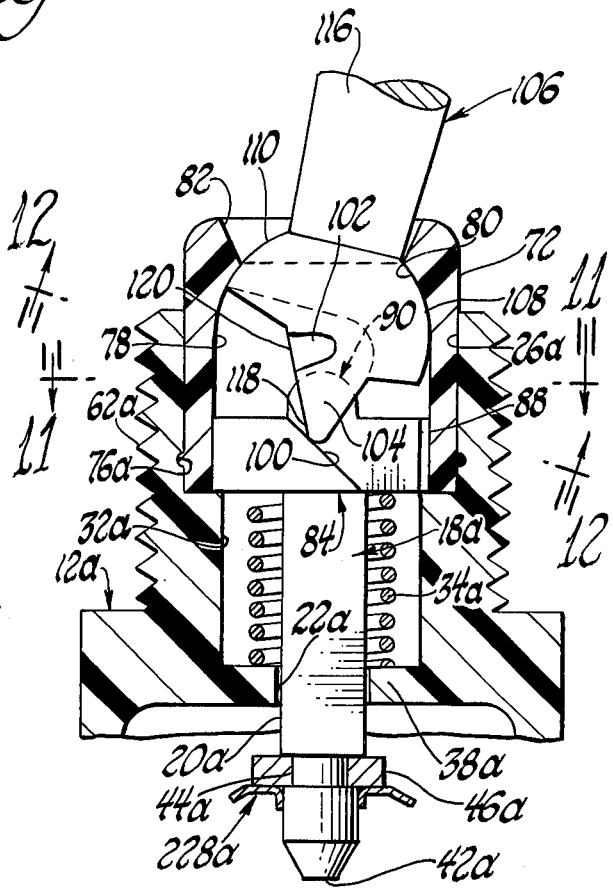
FIG. 6 is a view similar to that of FIG. 5 but illustrating a second condition of operation thereof.

FIGS. 5 and 6 illustrate a modification of the invention. All elements in FIGS. 5 and 6 which are like or similar to those of FIGS. 1–4 are identified with like reference numbers provided with a suffix "*a*".

In FIGS. 5 and 6, a generally tubular retainer 72, preferably of somewhat resiliently deflectable plastic material such as, for example, polypropylene, is closely received within cylindrical recess **26*a* and retained therein as by an annular peripherally formed ring portion 74, carried by retainer 72, cooperatively engaging annular recess 76*a* formed in the surface of cylindrical opening 26*a***.

Retainer 72 has an inner cylindrical surface 78 which, at the upper end (as viewed in FIGS. 5 and 6) thereof, blend into a spherical surface 80 through which a generally conical aperture 82 is formed.

Figure 11:
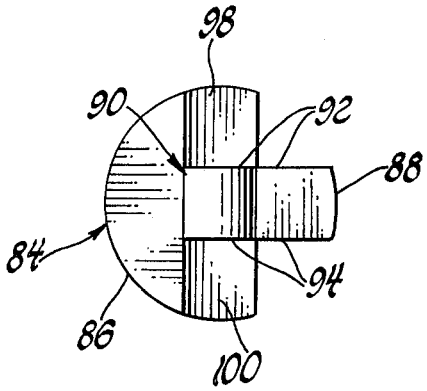
FIG. 11 is a partial view of one of the elements in FIGS. 5 and 6 taken generally on the plane of line 11—11 of FIG. 6 and looking in the direction of the arrows.

The upper end of plunger means **18*a* is provided with an enlarged section or body 84, operatively engaged by the lower-disposed spring 34*a*, which has an outer generally cylindrical and segmented surface as defined by cylindrical surface portions 86 and 88 slidably received within containing cylindrical surface 78. As also shown in FIG. 11, the body portion 84 is provided with an upwardly extending generally centrally situated guide portion 90 having flatted sides 92 and 94 and a generally radiused contour 96. Sides or surfaces 92 and 94 extend as to join the segmented cylindrical surface section 88. Further, inclined surfaces or ramp means 98 and 100, formed on opposite sides of guide portion 90, are adapted for cooperative engagement with respective cam portions 102 and 104 carried by lever or actuating means 106**.

Figure 12:
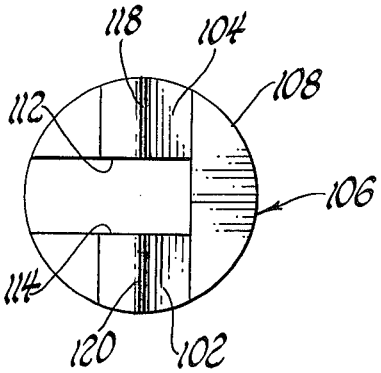
FIG. 12 is a partial view of another of the elements in FIGS. 5, 6, 7 and 8 taken generally on the plane of line 12—12 of FIG. 6 and looking in the direction of the arrows.

Lever means 106 has its body portion 108 formed as to have a generally spherical surface 110, adapted for cooperation with inner spherical surface 80 of retainer 72, which, when viewed as in FIG. 12, may have a generally circular projected outer configuration. As also shown in FIG. 12, a slot-like clearance or opening is provided generally medially so as to have the opposed side walls 112 and 114 thereof adapted for respective juxtaposition to sides or wall surfaces 94 and 92 of plunger means **18*a* while simultaneously receiving, within such clearance, guide portion 90**.

When lever means 106 is assembled as shown, spring **34*a* normally urges plunger means 18*a* generally outwardly (upwardly as viewed in FIGS. 5 and 6) causing lever means 106 to be urged generally counter-clockwise by virtue of ramp surfaces 98 and 100 urging cam portions or legs 102 and 104 generally to the right while spherical surface 110 of lever body 108 correspondingly rotates within spherical surface 80 of retainer 72. In the normal or un-actuated state, the elements would assume respective positions as generally depicted in FIG. 5**.

When plunger means **18*a* is to be depressed, the actuating means or lever 106 handle portion 116 is rotated from the position depicted in FIG. 5 towards the position depicted in FIG. 6. By so doing, the contacting or edge surfaces 118 and 120 of cam legs or portions 104 and 102 respectively react against inclined surfaces 100 and 98 causing plunger means 18*a* to be displaced downwardly. In the embodiment of FIGS. 5 and 6, the relative angle of the ramp surfaces 98 and 100, the force of spring 34*a*, the coefficient of friction and the overall geometry is preferably such as to result in spring 34*a* moving plunger means 18*a* and lever or actuating means 106 back to the position depicted in FIG. 5 whenever handle portion 116** is released.

Figure 7:
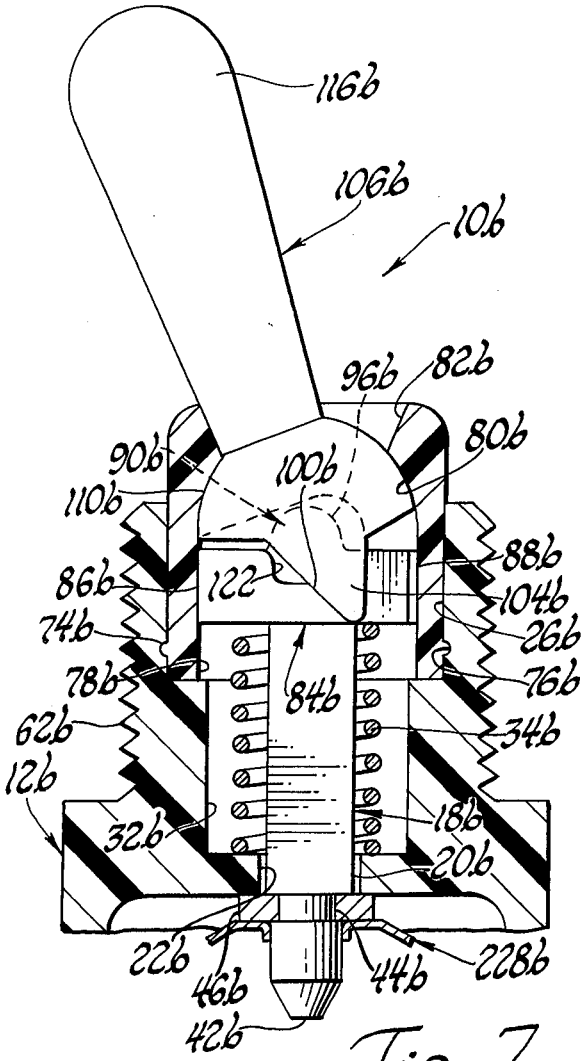
FIG. 7 is a view similar to that of FIG. 5 but illustrating a further modified form of the invention.
Figure 8:
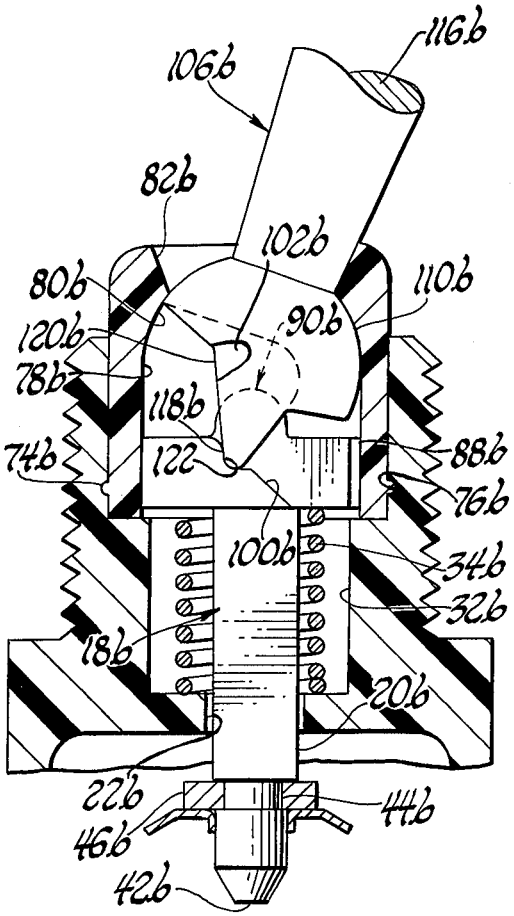
FIG. 8 is a view similar to that of FIG. 7 but illustrating a second condition of operation thereof.

FIGS. 7 and 8 illustrate a further modification of the invention. Those elements in FIGS. 7 and 8 which are like or similar to those of FIGS. 1–6 are identified with like reference numbers provided with a suffix "*b*". In comparing FIGS. 7 and 8 respectively to FIGS. 5 and 6, it can be seen that in the arrangement of FIGS. 7 and 8, the ramps or inclined surfaces each have a notch or step-like portion 122 formed therein and located such as to respectively receive the edge surfaces **118*b* and 120*b* of cam legs 104*b* and 102*b* when the actuating means 106*b* has attained an actuated position as generally depicted in FIG. 8. With the respective elements in their FIG. 8 positions, the line of force developed by spring 34*b* is such as to lock-in the cam legs 102*b* and 104*b* within notches 122 thereby precluding the automatic return to the FIG. 7 position of plunger means 18*b* upon release of actuating means 106*b*. Such return to the FIG. 7 position is attained only after the actuating means or lever 106b has been first manually actuated sufficiently to move cam legs 102b and 104b out of respective detent recesses 122**.

FIGS. 13, 14, 15 and 16 illustrate a further modification of the invention. Those elements in FIGS. 13, 14, 15 and 16 which are like or similar to those of FIGS. 1–12 are identified with like reference numerals provided with a suffix "C". In comparing, for example, FIGS. 13 and 15 to FIGS. 7 and 8 it can be seen that the most significant difference is that body 84c has opposed ramp or cam surfaces 300 and 302 as well as opposed ramp or cam surfaces 304 and 306 with such pairs of opposed surfaces being disposed generally on opposite sides of the centrally situated guide portion 90c.

Figure 13:
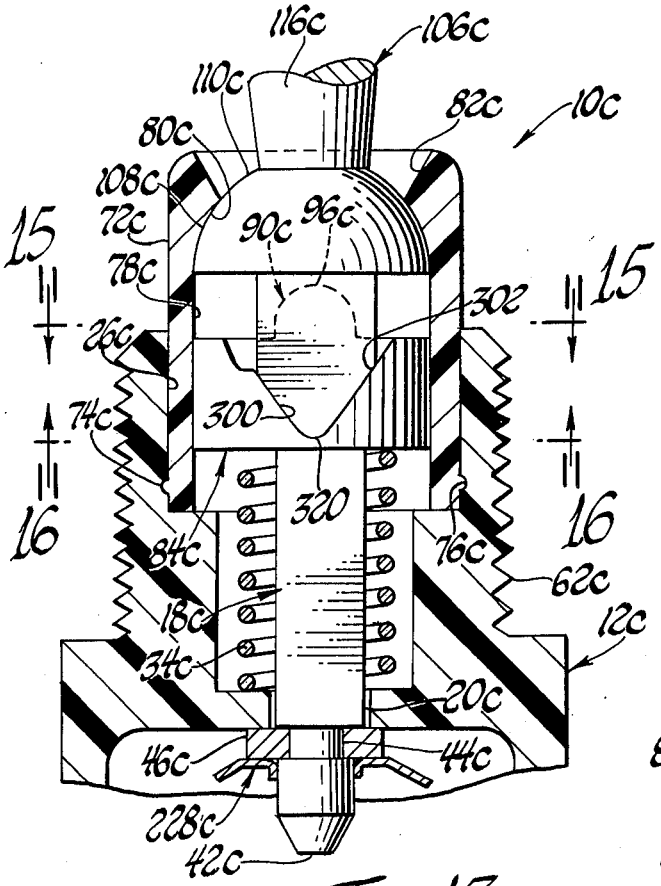
FIG. 13 is a view similar to that of FIG. 7 but illustrating a further modified form of the invention.
Figure 14:
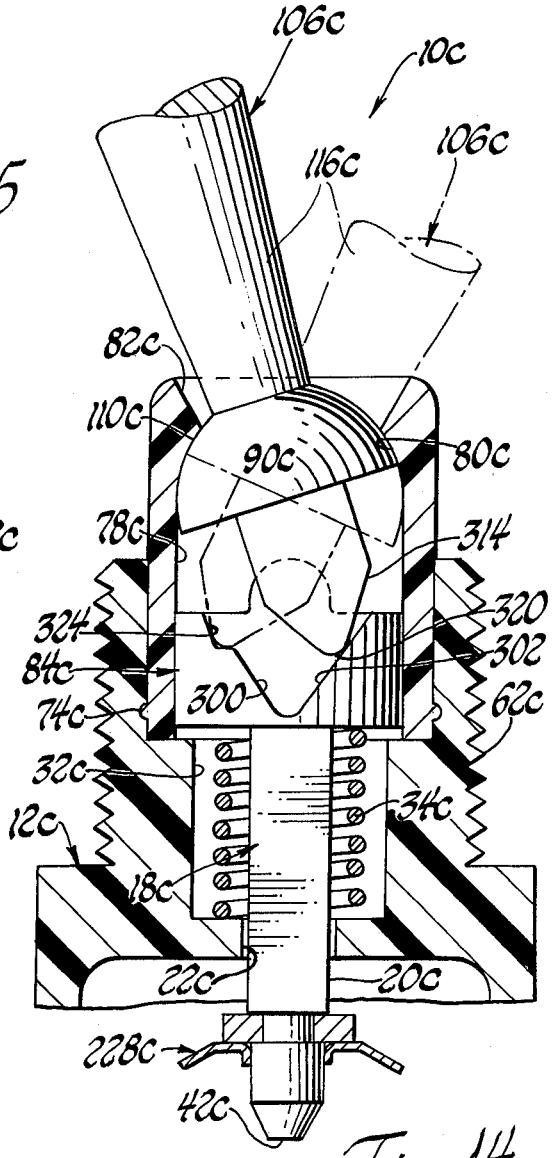
FIG. 14 is a view similar to that of FIG. 13 but illustrating other conditions of operation.
Figure 15:
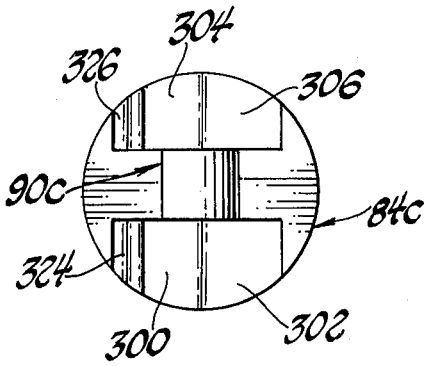
FIG. 15 is a view of one of the elements in FIGS. 13 and 14 taken generally on the plane of line 15—15 of FIG. 13, with other elements appearing in such plane being removed, and looking in the direction of the arrows.
Figure 16:
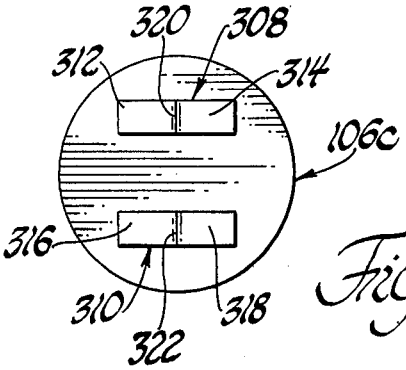
FIG. 16 is a view of another of the elements in FIGS. 13 and 14 taken generally on the plane of line 16—16 of FIG. 13, with other elements appearing in such plane being removed, and looking in the direction of the arrows.

As shown in FIGS. 13 and 16, for example, actuating means 106c is provided with laterally spaced legs 308 and 310 which respectively have edges 312, 314 and 316, 318 accommodated and received by the surfaces 300, 302 and 304, 306. When the actuating means 106c is in a null or neutral position as illustrated in FIGS. 13, edges 312, 314, 316 and 318 are respectively juxtaposed to surfaces 300, 302, 304 and 306. However, as portion 116c of actuating means 106c is pivotally actuated to the right or left as shown in FIG. 14, the apex 320 of edges 312, 314 and apex 322 of edges 316, 318 respectively engage surfaces 302 and 306 and forcibly axially displace body 84c against the resilient resistance of spring 34c. If after lever portion 166c has been rotated to the left as shown in FIG. 14, lever 116c is released, spring 34c will move plunger means 18c and body 84 upwardly causing the actuating means 106c to again assume the position depicted in FIG. 13, thereby providing a momentary quality or characteristic to the overall switch assembly.

However, if lever 116c is pivotally actuated a sufficient distance to the right as depicted in fantom line in FIG. 14, apexes 320 and 322 will, after respectively engaging surfaces 300 and 304 as to thereby axially displace body portion 84c, engage notch or step-like portions 324 and 326 formed generally into surfaces 300 and 304, respectively. If the lever portion 166c of actuating means 106c is then released, plunger means 18c and body portion 84c will remain in an actuated position because the then geometry of the respective elements is maintained by virtue of spring 34c tending to further rotate lever 116c of actuating means 106c in the clockwise direction which is prevented by the abutting engagement between lever portion 116c and wall of aperture 82c. In order to again have the elements return to the neutral position depicted by FIG. 13, the lever 116c must first be manually actuated as to remove apexes 320 and 322 from detents or notches 324 and 326 at which event, spring 34c will be able to return the cooperating elements to the FIG. 13 positions.

Referring now again to FIGS. 1 and 2, as well as to the other remaining Figures, body or housing section 14 is shown as carrying four electrical terminals 124, 126, 128 and 130 which, in the preferred form, have threaded externally situated shank portions. The body portions 132, 134, 136 and 138 of the respective terminals may be either pressed in or molded with housing section 14 as to be retained thereby. The flanges 140, 142, 144 and 146 prevent such terminals from being pushed inwardly of the switch assembly while generally longitudinally extending flatted surfaces, typically shown at 148, prevent rotation of the terminals with respect to housing section 14.

Terminal 124 has an inwardly extending post-like connecting portion 150, terminal 130 has an inwardly directed contact portion 152 while terminals 126 and 128 respectively have inwardly directed contact portions 154 and 156.

A switch contact-carrying arm 158 is shown as having its one end 160 situated atop a mounting surface 162, of housing 14, and suitably secured to post 150 as by, preferably, soldering. A cooperating aperture 164 permits the reception therethrough of post 150. The remaining portion of resiliently deflectable contact-carrying arm or conductor 158, which may be formed of, for example, beryllium copper, is illustrated in a generally cantilevered condition with respect to mounting surface 162. The other swingable end 166 of arm conductor 158 has an electrical contact 168 suitably affixed thereto so as to be in general juxtaposition with but spaced from fixed contact 152.

Generally intermediate mounting surface 162 and contact 152, a pedestal-like body portion 170 is formed with a generally planar abutment surface 172 as well as an integrally formed upstanding extension or support 174 which has a slot 176 formed therein and adapted to receive a flange or tab 178 of a U-shaped spring 180 as well as a spring retainer 182 of generally L-shaped configuration with the foot portion thereof serving to engage the underside of the flange 178 and thereby generally pivotally retain the spring 180 in slot 176.

Figure 10:
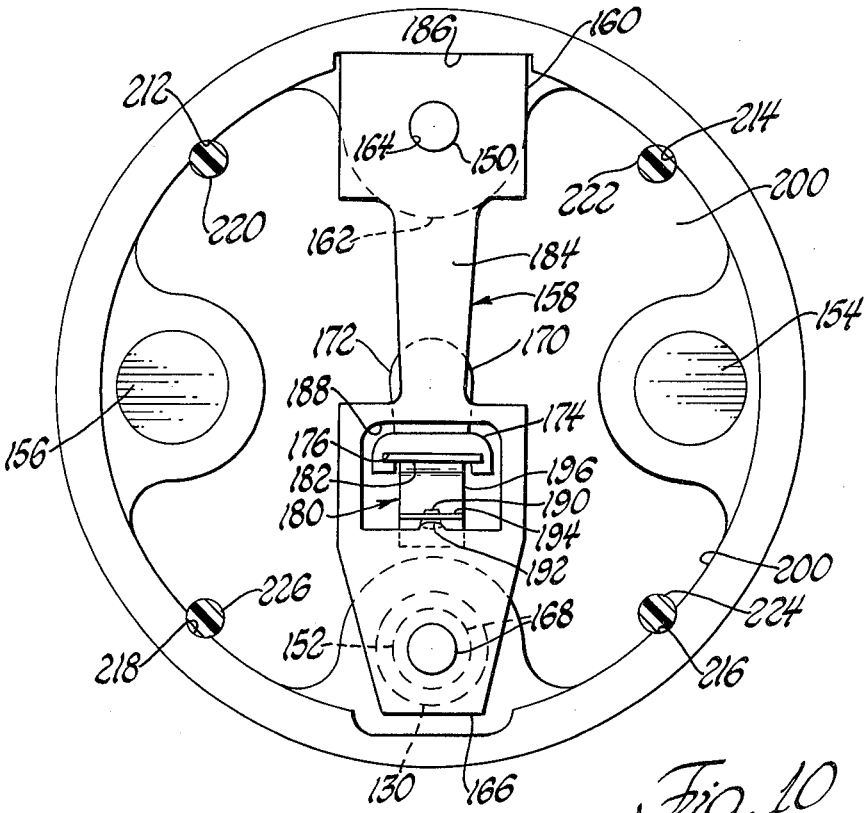
FIG. 10 is an axially transverse cross-sectional view taken generally on the plane of line 10—10 of FIG. 1 and looking in the direction of the arrows.

As is best seen in FIG. 10, end portions 160 and 166 are relatively wide and interconnected by a relatively narrow intermediate body portion 184. Preferably end 160 is closely received within a notched-out portion 186 which serves to automatically properly locate the arm 158 during assembly. The end portion 166 has a generally rectangular cut-out or aperture 188 formed therein and adapted to receive, therethrough, the spring perch or support 174. An integrally formed finger-like portion 190 extends generally into the aperture 188 and is adapted to be received within a cooperating aperture 192 formed in one leg 194 of U-shaped spring 180 which has its other leg 196 carrying the flange or tab 178.

With reference to FIGS. 1 and 10, it can be seen that when the switch assembly 10 is in a normal condition, that is, with plunger means 18 in the position shown, leg 194 of spring 180 contained and generally confined within opening 188 is resiliently deflected toward the other leg 196 as well as the spring perch 174.

Figure 3:
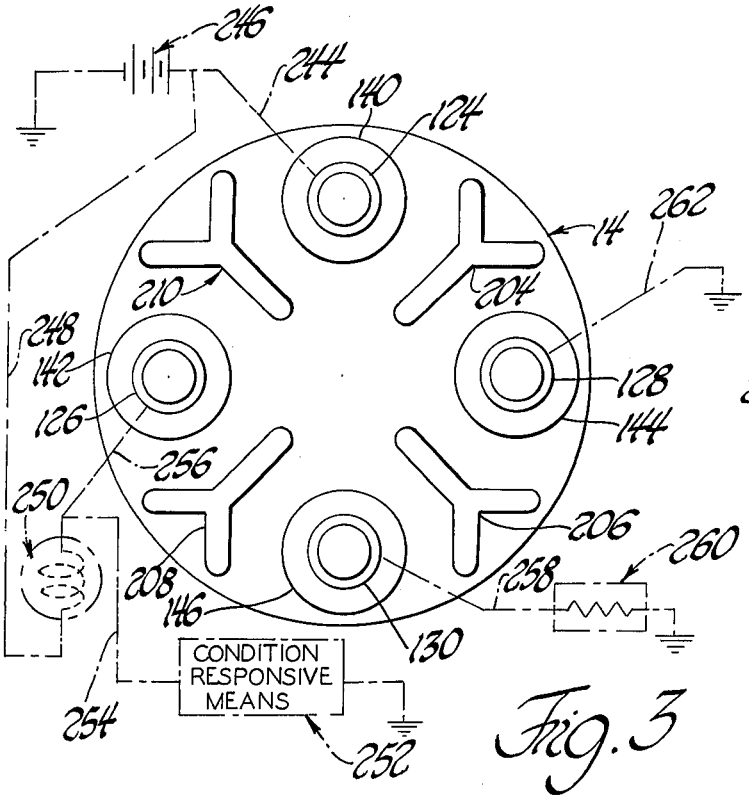
FIG. 3 is a view taken generally on the plane of line 3—3 of FIG. 1 and looking in the direction of the arrows.

As can best be seen in FIGS. 1 and 3, body or housing section 14 is basically of cup-shaped configuration having an end or bottom wall 200 with an integrally formed annular or cylindrical side wall 202. In the preferred form, additional strengthening ribs or rib configurations 204, 206, 208 and 210 are formed integrally with and externally of end wall 200. Further, as shown in FIG. 10 and partly shown in FIG. 1, in the preferred embodiment, a plurality of generally axially extending grooves or recesses 212, 214, 216 and 218 are formed in the inner surface of wall 200 as to be spaced from each other and adapted to respectively receive therein locating pins or extensions 220, 222, 224 and 226 which are preferably formed integrally with housing or body section 12.

Referring in greater detail to FIGS. 1, 2 and 4, in the preferred embodiment a second electrically conductive member 228 is shown as having a generally medially disposed aperture 230 for tightly engaging surface portion 232 of plunger means 18 as to thereby be retained thereto. Member 228, which may be formed of, for example, beryllium copper, is a generally resiliently deflectable leaf contact means having a centrally disposed body portion 234 and integrally formed legs or arms 236 and 238 extending angularly and radially therefrom with such arms 236 and 238 respectively having contact portions 240 and 242 at the ends thereof. The leaf-like contact means 228 is so positioned as to have contact portions 240 and 242 generally juxtaposed to contacts 156 and 154, respectively.

OPERATION OF THE INVENTION

As generally indicated in FIG. 3, terminal 124 may be electrically connected via conductor means 244 to a suitable related source of electrical potential 246 which, in turn, may also be electrically connected as by conductor means 248 to, for example, lamp or other suitable indicia indicator means 250 which is normally in an unenergized state except when associated condition responsive means, as at 252, in response to sensing the attainment of a preselected operating condition, function to close the circuit through means 250, conductor 254 and to ground. As shown, the indicia indicator means 250 is also electrically connected via conductor means 256, in parallel to conductor 254, to switch terminal 126.

Terminal 130 may be electrically connected as by conductor means 258 to related main electrical load means 260 while terminal 128 is shown connected to ground potential as by conductor means 262. By way of example, load means 260 may be an electrical starter system for an internal combustion engine.

In the normal condition of the switch assembly, the various elements comprising switch assembly 10 (or 10*a* or 10*b*) would assume positions as depicted in FIGS. 1 and 2 (or FIGS. 5 and 2 or FIGS. 7 and 2). At this time the resilient force of the somewhat pre-loaded U-shaped spring 180 causes the contact member 158 and end 166 to ssume a position which results in the lowest possible preload to exist in U-shaped spring 180. This, of course, causes member 158 to assume a position substantially as depicted in FIG. 1 with the result that the upper movable contact 168, carried by end 166, is held away from lower fixed electrical contact 152. In this condition, the electrical circuit through terminals 124 and 130 is open.

Further, with the elements in the positions shown in FIGS. 1 and 2, the spring contact means 228 is also held as to keep movable contact portions 240 and 242 respectively away from cooperating fixed contacts 156 and 154. Therefore, under such condition, the electrical circuit between terminals 128 and 126 is also open.

When it is desired that the switch assembly complete or close an electrical circuit, or circuits, therethrough, switch actuator means 56, 106 and 106*b* are actuated, as previously described, causing plunger means 18 to move against the resilient resistance of spring 34 and generally inwardly of the switch assembly towards cantilevered contact means 158. When the end 42 of electrically non-conductive plunger means 18 reaches contact arm 158 and continues to move thereagainst, the portion 184 or arm 158, which is resiliently deflectable, starts to move toward surface 172 of pedestal portion 170 in a somewhat bowed configuration. That is, the initial force applied by plunger means end 42 is not sufficient to overcome the resilient resistance of U-shaped spring 180 which must experience a degree of increased deflection before it will permit downward movement (to the right as viewed in FIG. 1) of the end portion 166 and contact 168 carried thereby.

Accordingly, as plunger means end 42 continues to exert an increased downward force against the medial portion 184 of arm 158 causing it to bow to a greater extent, the U-shaped spring 180 experiences two-directional resulting force components. One of such components causes leg 194 to be further deflected toward opposed leg 196 while the other force component is generally parallel to the direction of movement of plunger means 18 tending to move or deflect the U-shaped spring 180 generally towards wall 200 of body or housing section 14. When such force components become sufficiently great, the U-shaped spring 180 in effect snaps toward wall 200 (while still exhibiting a slight upward resilient force) causing plunger means end 42 to hold arm portion 184 against abutment surface 172 while, simultaneously, movable contact 168 is snapped down against fixed contact 152 of terminal 130 thereby completing an electrical circuit as from terminal 124, through post 150, contact arm 158, contact 168, contact 152 and terminal 130.

Of course, when the external force applied to the actuating means is removed, both the resilience of contact arm 158 and any existing resilience of spring 180 cause contact arm 158 including movable contact 168 to again move upwardly (toward the left as viewed in FIG. 1) assuming a position as generally depicted in FIG. 1.

When the plunger means 18 is actuated downwardly (to the right as viewed in FIG. 1) as hereinbefore described, it should be apparent that leaf-type contact means 228 is also moved in the same direction and towards engagement with fixed contacts 156 and 154. In the preferred embodiment of the invention, the distance that plunger means 18 has to move in order to achieve operative engagement between contact portion 240 and contact 156 or between contact portion 242 and contact 154 is substantially less than the distance which plunger means 18 must move in order to cause cantilevered arm contact means 158 to snap-over and attain operative engagement as between movable contact 168 and fixed contact 152.

In any even, when operative engagement of contact portions 240 and 242 is respectively made with fixed contacts 156 and 154 a circuit is completed as from terminal 128, through leaf contact means 228 and to terminal 126. It should be apparent that if after such operative engagement is attained plunger means 18 continues to move to the right as viewed in FIGS. 1 and 2, that legs 236 and 238 will be forcibly moved or deflected generally radially outwardly causing contact portions 240 and 242 to, during such movement, wipe across the surfaces of fixed contacts 156 and 154 thereby serving to continually clean such surfaces and assure the removal therefrom (as well as from the contact) portions 240 and 242) of any deposits or impurities which might otherwise exhibit a deleterious effect on the flow of current as between cooperating engaging contacts.

If the switch assembly were employed in the environment of FIG. 3, the initial movement of plunger means 18 causing the circuit from terminal 126 to terminal 128 to be closed, would cause test energization of indicia indicator means 250 to determine whether such warning means 250 was operative. Further movement of plunger means 18 would close the circuit as between terminals 124 and 130 causing energization of the load means 260.

Of course, as already apparent, the switch means of the invention is of a momentary type in that releasing the actuating means causes the automatic return of the elements as to, for example, that shown in FIGS. 1 and 2. This is true with the exception of the modification of FIGS. 7 and 8 wherein, if the actuating means **106*b* is moved sufficiently, the elements will not return to their original normal positions unless first such actuating means 106*b* is manually moved from the locked detent position of FIG. 8**.

In the preferred embodiment, the housing sections are formed of plastic materials such as, for example, polypropylene. Although body or housing sections 12 and 14 may be secured to each other by any suitable means, as for example mechanically by screws or such, or adhesively by suitable cementing means, in the preferred embodiment, housing sections 12 and 14 are heat fused to each other along the juxtaposed abutting surfaces therebetween. In order to enhance such fusion, a bead-like annular ring protuberance may be initially formed on, for example, body section 12 as generally depicted, fragmentarily, by fantom lines at 270 of FIG. 2. Such a protuberance would serve to localize the heating and enhance fusion as between housing sections 12 and 14.

Although only one preferred embodiment and selected modifications of the invention have been disclosed and described, it is apparent that other embodiments and modifications of the invention are possible within the scope of the appended claims.

I CLAIM:

1. An electrical switch assembly, comprising first and second relatively fixed electrical conductor means spaced from each other, third electrical conductor means operatively connected to said first conductor means and normally spaced from said second electrical conductor means, resilient restraining means operatively connected to said third electrical conductor means and normally resiliently maintaining said third electrical conductor means spaced from said second electrical conductor means, actuator means effective for creating a force against said resilient restraining means so as to cause said third electrical conductor means to move toward said second electrical conductor means and thereby complete a first electrical circuit portion from said first conductor means through said third conductor means to said second conductor means, fourth and fifth relatively fixed electrical conductor means spaced from each other, and sixth electrical conductor means carried by said actuator means and normally spaced from said fourth and fifth conductor means, said sixth conductor means being effective when moved by said actuator means to operatively engage and complete a second electrical circuit portion from said fourth electrical conductor means through said sixth electrical conductor means to said fifth electrical conductor means, said actuator means comprising axially movable plunger means, second resilient means effective to resiliently urge said plunger means in a first direction away from said third conductor means, and manually engageable actuating means adapted to be manually engaged and actuated as to thereby move said plunger means in a second direction toward said third conductor means, said sixth conductor means comprising a generally medially supported leaf-type contact means having first and second electrical contact portions, said leaf-type contact means being generally medially affixed to said plunger means as to be carried thereby and movable therewith in said first and second directions, guide means effective for preventing undue relative angular rotation of said first and second electrical contact portions as to thereby assure operative alignment as between said first and second electrical contact portions and said fourth and fifth fixed electrical conductor means, said leaf-type contact means comprising a generally medially situated main body portion, first and second contact leg portions respectively carried by their respective one ends by said main body portion as to generally both radiate outwardly therefrom and extend in said second directon, said first electrical contact portion being carried at least near a free end of said first contact leg portion, said second electrical contact portion being carried at least near a free end of said second contact leg portion, and said first and second contact portions being effective to respectively engage and wipe across said fourth and fifth conductor means when said plunger means has been sufficiently axially moved in said second direction, said third conductor means comprising a spring-like cantilevered contact means having a first end anchored against movement and electrically connected to said first conductor means and having a second swingable end normally spaced from and movable toward and into engagement with said second conductor means, said cantilevered contact means being situated as to be generally transverse to said leaf-type contact means and between said first and second contact leg portions, said first and second contact leg portions being generally spaced from each other as to be respectively at opposite sides of said cantilevered contact means thereby bridging said cantilevered contact means when said first and second contact portions engage said fourth and fifth conductor means.

2. An electric switch assembly according to claim 1 wherein said first electrical conductor means comprises a terminal post connected to said first end of said third conductor means, wherein said second, fourth and fifth conductor means each comprise respective fixed electrical contact members, and wherein said third conductor means comprises a third contact member carried at said second end thereof.

3. An electric switch assembly according to claim 2 and further comprising housing means for containing all of said conductor means and for supporting said actuator means, said housing means comprising first and second housing sections each of which is formed of electrically nonconductive material and fused to each other.

4. An electric switch assembly according to claim 1 and further comprising housing means for carrying all of said conductor means and said actuator means, first flatted key-like surface means formed on said plunger means, and second flatted key-like surface means formed in said housing means, said first and second key-like surface means being effective to cooperate with each other in preventing unobstructed angular rotation of said plunger means relative to said housing means while permitting relative axial movement therebetween.

5. electric switch assembly according to claim 1 wherein said actuating means comprises lever-operated cam means for affecting axial movement of said plunger means, said cam means comprising first and second cam bodies, said first cam body being carried by said plunger means generally at one end thereof, said first cam body comprising first inclined ramp-like cam surface means, said second cam body means being operatively carried by manually actuatable handle means, said second cam body comprising second inclined ramp-like cam surface means operatively engaging said first cam surface means, and wherein said second resilient means is effective to maintain said first and second cam bodies in operative engagement with each other.

6. An electric switch assembly according to claim 5 wherein said actuating means further comprises detent means for holding said plunger means against said third conductor means once said plunger means has been axially moved thereagainst by said lever-operated cam means, said detent means comprising recess-like means formed in said first cam body, said recess-like means being effective to receive a portion of said second cam body therein after the circuit from said first conductor means to said second conductor means has been completed and after the circuit from said fourth conductor means to said fifth conductor means has been completed and after said plunger means has been moved still further in said second direction.

7. An electric switch assembly according to claim 5 wherein said first inclined ramp-like surface means comprises first and second ramp-like surfaces laterally spaced from each other, and wherein said second inclined ramp-like surface means comprises third and fourth ramp-like surfaces spaced from each other.

8. An electric switch assembly according to claim 7 and further comprising a tang-like extension carried by said first cam body as to be situated between said first and second ramp-like surfaces and extending toward said second cam body, and recess means formed in said second cam body for slidably receiving at least a portion of said tang-like extension therein and between said third and fourth ramp-like surfaces.

9. A normally open electric switch assembly, comprising at least first and second relatively fixed electrical conductor means spaced from each other, third electrical conductor means operatively connected to said first conductor means and normally spaced from said second electrical conductor means, resilient restraining means operatively connected to said third electrical conductor means and normally resiliently maintaining said third electrical conductor means spaced from said second electrical conductor means, manually engageable and actuatable electrically nonconductive actuator means effective for creating a force against said resilient restraining means so as to cause said third electrical conductor means to move toward said second electrical conductor means for operative electrical contact therewith and thereby complete an electrical circuit from said first to said second electrical conductor means, said first electrical conductor means comprising a first fixed electrical contact portion, said second electrical conductor means comprising a second fixed electrical contact portion, said third electrical conductor means comprising a resiliently deflectable electrically conductive arm member connected at one end to said first contact portion and supported at said one end in a manner providing for deflection of at least a portion thereof as to thereby be effective for completing an electrical current path as between said first and second electrical contact portions, said actuator means being effective for operatively engaging said arm member for causing said third electrical conductor means to move toward an electrically closed position against said second fixed electrical contact portion, a leaf-type electrical conductor carrying fourth and fifth contact portions, sixth and seventh relatively fixed electrical conductor means spaced from each other, first and second housing sections, said first housing section being effective for carrying said first, second, third, sixth and seventh electrical conductor means, said first housing section carrying said resilient restraining means in a manner as to be situated generally medially of said first and second electrical conductor means, said arm member being cantilevered from a portion of said first housing section, said first housing section further comprising an abutment portion formed in general juxtaposition to said arm member, said actuator means comprising a plunger-like member slideably received within said second housing section and carrying said leaf-type electrical conductor for movement therewith into and out of operative engagement with said sixth and seventh conductor means, said abutment portion being effective for providing a fixed stop for limiting the degree of deflection of said arm member by said plunger member, said abutment portion being so located as to be generally axially medially of said first housing section, said plunger-like member being so located as to be generally axially aligned with the axial medial portion of said second housing section, said first and second electrical conductor means comprising terminal members secured to said first body section, and said leaf-type conductor being positioned generally transverse to and stradling said arm member.

* * * * *

UNITED STATES PATENT OFFICE

CERTIFICATE OF CORRECTION

Patent No. 4,081,633 Dated March 28, 1978

Inventor(s) David W Bull

It is certified that error appears in the above-identified patent and that said Letters Patent are hereby corrected as shown below:

Column 5, line 31, change "84" to --- 84c ---.

Column 8, line 42, change "even" to --- event ---.

Column 8, line 54, after "contact" delete the parenthesis ")".

Claim 5, line 1 thereof, immediately before "electric" insert --- An ---.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*